US006828737B2

(12) United States Patent
Busse et al.

(10) Patent No.: US 6,828,737 B2
(45) **Date of Patent: *Dec. 7, 2004**

(54) DISCHARGE LAMP OPERATING CIRCUIT WITH A CURRENT REGULATION CIRCUIT AND A CIRCUIT FOR DETECTION OF THE PROXIMITY TO CAPACITIVE OPERATION

(75) Inventors: Olaf Busse, München (DE); Markus Heckmann, München (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/458,676

(22) Filed: Jun. 11, 2003

(65) Prior Publication Data

US 2004/0036426 A1 Feb. 26, 2004

(30) Foreign Application Priority Data

Jun. 11, 2002 (DE) ..... 102 25 880

(51) Int. Cl.[7] ..... H05B 37/02

(52) U.S. Cl. ..... 315/224; 315/209 R; 315/244; 315/291; 315/307; 315/DIG. 5

(58) Field of Search ..... 315/224, 291, 315/307, 209 R, 200 R, 247, 244, 194, 119, DIG. 5, DIG. 7

(56) References Cited

U.S. PATENT DOCUMENTS

| | | | | | |
|---|---|---|---|---|---|
| 4,928,038 | A | * | 5/1990 | Nerone | 315/209 R |
| 5,075,602 | A | * | 12/1991 | Overgoor et al. | 315/307 |
| 5,914,572 | A | * | 6/1999 | Qian et al. | 315/307 |
| 6,008,590 | A | * | 12/1999 | Giannopoulos et al. | 315/209 R |
| 6,331,755 | B1 | | 12/2001 | Ribarich et al. | 315/225 |
| 6,400,095 | B1 | * | 6/2002 | Primisser et al. | 315/224 |
| 6,707,262 | B2 | * | 3/2004 | Busse et al. | 315/224 |

* cited by examiner

*Primary Examiner*—Don Wong
*Assistant Examiner*—Ephrem Alemu

(57) ABSTRACT

The invention relates to an operating circuit for a discharge lamp with a current regulation circuit for regulating the lamp current and a detection circuit for identifying proximity to capacitive operation of the load circuit. The operating circuit is designed to reduce the nominal current value on identifying proximity to capacitive operation.

10 Claims, 2 Drawing Sheets

Figure 1:
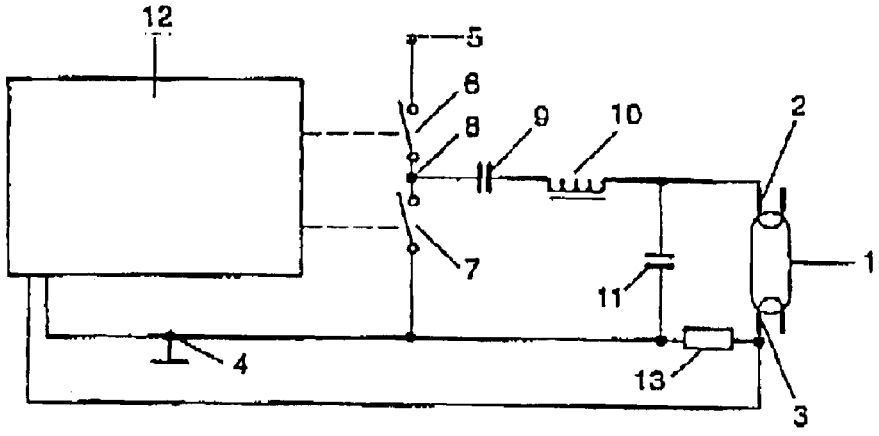

DISCHARGE LAMP OPERATING CIRCUIT WITH A CURRENT REGULATION CIRCUIT AND A CIRCUIT FOR DETECTION OF THE PROXIMITY TO CAPACITIVE OPERATION

TECHNICAL FIELD

The invention relates to an operating circuit for discharge lamps.

In this case, the invention relates to operating circuits which supply the discharge lamp with radio-frequency supply power which is obtained from a supply power via an oscillator circuit. In particular, but not necessarily, the invention relates to the situation where the supply power for the oscillator circuit is obtained from an AC voltage supply power which is rectified. Operating circuits such as these are in general use, in particular for low-pressure discharge lamps, and there is therefore no need to explain their details.

BACKGROUND ART

The oscillator circuit in this case supplies a so-called load circuit, in which the discharge lamp is connected, and through which a radio-frequency lamp current flows, which is produced by the oscillator circuit. The load circuit in this case defines a resonant frequency, which is influenced by various electrical parameters of the load circuit and also depends, inter alia, on the operating state of the discharge lamp. The aim is to operate the load circuit relatively close to the resonant frequency during continuous operation of the discharge lamp. This has the advantage of small phase shifts between the current and voltage, and hence of small reactive currents. This is beneficial for dimensioning of the components, particularly for a lamp inductor. Apart from this, the oscillator circuit which produces the radio-frequency supply power normally contains switching elements. When the phase shifts are low as a result of operation close to resonance, the switching losses in the switching elements are relatively small. This has advantages with regard to the efficiency of the operating circuit and with regard to the thermal load and the dimensioning of the switching elements.

Normally, one aim is to operate in the so-called inductive region, that is to say at an oscillator circuit operating frequency that is higher than the resonant frequency of the load circuit. However, in this case, it is necessary to avoid the operating frequency of the oscillator circuit becoming less than the resonant frequency since disturbing current spikes can be produced in the switching elements, and other difficulties can occur, in capacitive operation, that is to say when the operating frequency is less than the resonant frequency. In particular, incorrect synchronization between the switching times and the lamp inductor current during capacitive operation can lead to a pronounced positive current spike at the start of a lamp current half-cycle that is carried by a switching element. Thus, overall, it is desirable to operate as close as possible to the resonant frequency although, as far as possible, the frequency should not fall below the resonant frequency, or this should occur only to a restricted extent.

However, temperature changes and aging processes such as electrode wear, mercury diffusion in fluorescent substances and other aging phenomena as well as scatter between the individual examples of different individual discharge lamps result in fluctuations in the lamp impedance (with respect to continuous operation).

These lamp impedance fluctuations and the normal component tolerances mean that the operating circuits cannot easily be set relatively accurately to operation close to resonance. In fact, for safety reasons, a relatively large margin is maintained from the nominal resonant frequency, to take account of the fluctuations and tolerances as described. This results in higher component costs and an increased amount of space being required owing to correspondingly larger dimensioning and in reductions in efficiency.

Attempts have therefore already been made to equip operating circuits of the type described with detection circuits for identifying proximity to capacitive operation of the load circuit. By way of example, FIG. 5 in U.S. Pat. No. 6,331,755 illustrates a resistor RCS for measuring a lamp inductor current, and a comparator COMP for comparing this inductor current with a threshold value. The comparison is carried out on a switching-off flank of a switching transistor in a half-bridge oscillator circuit. The closer the operating frequency is to the resonant frequency and hence to capacitive operation, the smaller not only is a switching-on peak of the measurement voltage (at which the mathematical sign is reversed) across the resistor RCS, but the greater is the extent to which the measurement voltage falls, as well, at the end of the time for which said switching transistor is switched on. The threshold value therefore allows a limit state to be set, at which the circuit is switched off overall (shown on the right in FIG. 6 in that document), when operation becomes too close to resonance.

DESCLOSURE OF THE INVENTION

Against the background of the cited prior art, the invention is based on the technical problem of further improving an operating circuit for a discharge lamp having an oscillator circuit and having a detection circuit for identifying proximity to capacitive operation of the load circuit.

The invention relates to an operating circuit of the described type, in which a regulation circuit is provided for regulating the load circuit, in particular the lamp power or the lamp current, to a nominal regulation value, and the operating circuit is designed to reduce the nominal regulation value in response to the detection circuit identifying proximity to capacitive operation.

Preferred embodiments are specified in the dependent claims.

According to the invention, the operating circuit is not switched off, as in the case of the prior art, when specific proximity to capacitive operation is identified but, at least normally, is still operated. Identification of proximity to capacitive operation is thus intended to lead to the method of operation being influenced such that this proximity is at least not increased any further, or is even reduced, in order to allow operation to continue. For this purpose, the nominal regulation value, that is to say by way of example the nominal power or current value, of a regulation circuit is reduced. The regulation circuit intrinsically has the purpose and advantage of reducing the influence on lamp operation of scatter between individual lamps and fluctuations which occur over time, such as temperature fluctuations or aging influences. In the invention, a regulation circuit furthermore offers a particularly advantageous and simple capability to prevent capacitive operation by influencing the nominal regulation value. In one preferred embodiment of the regulation circuit, changing the nominal regulation value can also be associated with indirectly influencing the operating frequency of the oscillator circuit, because the regulation circuit preferably influences the operating frequency, in order to regulate the load circuit. In plain words, the operating circuit according to the invention is thus designed not to excessively approach capacitive operation during continuous operation and to counteract any further approach if it becomes too close, but with lamp operation continuing. This is because it is more tolerable from the point of view of the invention for the discharge lamp to become slightly darker in situations such as this than for it to be switched off entirely.

The invention is preferably distinguished by the detection circuit identifying proximity to capacitive operation in a particularly advantageous form. To do this, the detection circuit detects the magnitude of fluctuations of the lamp current corresponding to the frequency of the supply power. If the oscillator circuit is supplied with a rectified AC supply power, the supply power of the oscillator circuit fluctuates with the fluctuations (which result from the AC frequency) of the rectified supply voltage (so-called intermediate circuit voltage). The intermediate circuit voltage is thus modulated at twice the frequency of the original AC voltage. The doubling of the frequency is a consequence of the rectification process. Theoretically, it is also feasible in this case for no frequency doubling to occur; in any case, the modulation of the intermediate circuit voltage is related to the frequency of the original AC voltage.

This intermediate circuit voltage modulation can generally still be measured in the lamp current itself, to be precise even when the lamp current is regulated by means of a current or power regulation circuit. Depending on the technical complexity, regulation circuits are able to attenuate this modulation only to a limited extent.

Incidentally, this is also true in the situation, which represents one preferred embodiment of the invention, in which the rectified AC supply power is converted to a largely constant DC voltage by means of a power factor correction circuit (PFC circuit). The PFC circuit is used to limit the harmonic content of the power consumption from the AC voltage network, and generally charges an energy storage capacitor to the intermediate circuit DC voltage. The intermediate circuit voltage is also then modulated to a certain extent on the basis of the AC voltage frequency.

The magnitude of the lamp current fluctuations depends on the proximity to the resonant frequency and hence on the proximity to capacitive operation. This follows from the increase in the lamp current with increasing proximity to resonance on the one hand, and from the modulation of the proximity to resonance by the intermediate circuit voltage modulation, on the other hand.

The magnitude of the fluctuations of the lamp current thus offers a particularly simple possible way to detect proximity to capacitive operation. In particular, this relates to a signal which varies, for example, at twice the mains frequency of the AC voltage network, and which to this extent does not represent any significant measurement difficulties. On the other hand, the conventional solutions for detecting proximity to capacitive operation are linked to the operating frequency of the oscillator circuit itself and must be related to these phases, which involves a considerably greater degree of circuitry complexity. In the case of the invention, the lamp current has to be measured in any case, in order to carry out the current regulation that has already been mentioned. Thus, overall, the invention is associated with less additional complexity.

The description here has referred in general to a variable supply power. As stated above, this may on the one hand be a rectified AC supply power. However, the invention also covers the situation where the operating circuit is operated from a DC voltage source. There is then no need for a rectifier, or any rectifier which is provided in any case has no effect. However, even in this case, it may be desirable to use the invention. The DC voltage or intermediate circuit voltage may be deliberately modulated for this purpose. In addition to the capability for detection according to the invention of the proximity to capacitive load circuit operation, this furthermore has the advantage that the modulation results in a broadening of the frequency spectrum of radio-frequency interference which is transmitted through the operating circuit to the DC voltage source. The interference is thus less problematic because it occurs over a wider, and hence flatter, interference spectrum. Thus, for the purposes of the claims, the variable supply powers may also be deliberately modulated DC supply powers. In particular, the invention also relates to combination operating circuits which are intended for operation from both DC and AC voltage sources.

Furthermore, the invention alternatively relates to detection of the magnitude of fluctuations of the lamp current itself even in a situation where the lamp current is governed by a regulation circuit for regulating the load circuit, that is to say in particular the lamp current or the lamp power, with a manipulated variable for the regulation circuit then being detected, that is to say the changes in the regulation circuit while the regulation circuit is trying to stabilize the controlled variable. The manipulated variable could then be regarded as an image of the lamp current fluctuations, even when the latter are not occurring, or are occurring only to a minor extent.

The regulation circuit preferably has an I regulation element, that is to say an integrating element, in order to compensate for the comparatively slow parameter changes in the discharge lamp in the sense of the described impedance changes caused by aging or other long-term fluctuations. An I regulation element such as this will be sufficient in many cases. If required, it may be supplemented by a P regulation element (proportional element) or by some other additional device in order to take better account of the intermediate circuit voltage modulation.

In particular, it is possible to provide for the detection circuit to compare the magnitude of the fluctuations with a predetermined threshold value and not to influence operation any further unless the threshold value is exceeded. If the threshold value is exceeded, the detection circuit can either continuously vary the nominal regulation value in accordance with a regulation context, or else can vary it by a predetermined fixed amount, as is described in the exemplary embodiment. In any case, the comparison with the threshold value preferably results in a detection circuit function which does not influence operation in normal circumstances.

In particular, the regulation circuit and any other control of the oscillator circuit can be provided by means of an integrated digital circuit which need have only a small number of additional functions. Furthermore, the digital circuit may be a programmable circuit or a so-called microcontroller, in which case the additional complexity that is required for the invention can be restricted just to additional software.

A digital control circuit such as this or a microcontroller such as this may also, in particular, control the PFC circuit that has been mentioned, in addition to controlling the oscillator circuit.

SHORT DESCRIPTION OF THE DRAWINGS

The invention will be described in more detail in the following text with reference to an exemplary embodiment, although the features which are described in this case may be significant to the invention in other combinations as well. In particular, it should be mentioned that the description above and the description in the following text should also be understood with regard to the method category.

Figure 2A:
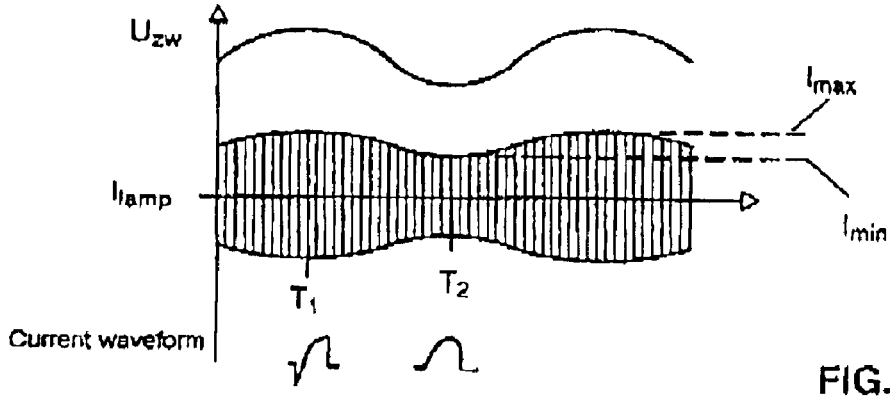
Figure 2B:
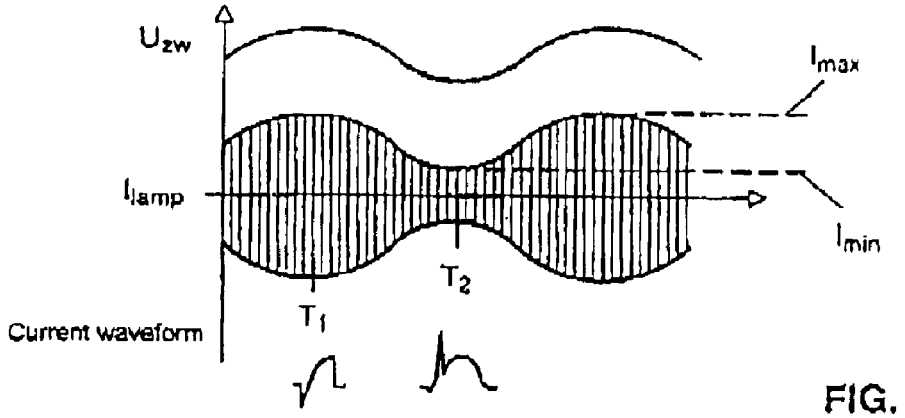
Figure 3:
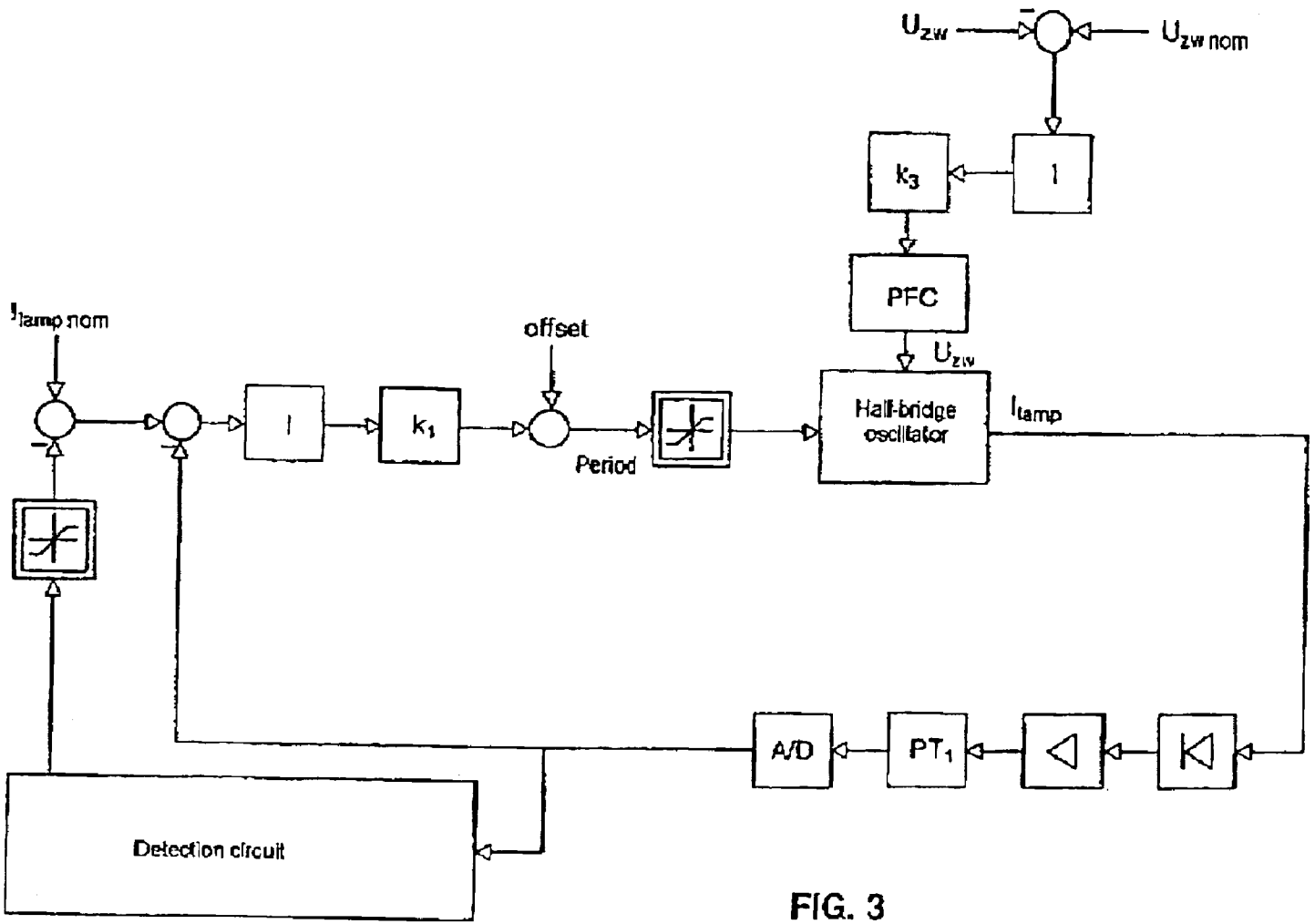

FIG. 1 shows a schematic illustration of operating equipment according to the invention;

FIG. 2*a* shows, schematically, the relationship between the intermediate circuit voltage, the discharge lamp current and the qualitative current waveform in switching elements of an oscillator circuit in an operating circuit according to the invention;

FIG. 2*b* corresponds to FIG. 2*a*, but relates to an operating state closer to resonance; and FIG. 3 shows a block diagram of a program sequence in a control circuit in the operating circuit shown in FIG. 1.

BEST MODE FOR CARRYING OUT THE INVENTION

In FIG. 1, the reference number 1 denotes a low-pressure discharge lamp with two incandescent filament electrodes 2 and 3. A half-bridge oscillator circuit with two switching transistors 6 and 7, which is known per se, is connected between a ground connection 4 and an intermediate circuit supply voltage 5. The two switching transistors 6 and 7 can be switched alternately in order to switch a center tap 8 between the intermediate circuit supply voltage and the ground potential. A radio-frequency supply voltage for the discharge lamp 1 can thus be produced from the rectified intermediate circuit supply voltage, which is applied to the connection 5 and is obtained from a mains voltage via a rectifier bridge circuit, which is known per se, with a PFC circuit.

The PFC circuit, which is not shown in FIG. 1, may be a so-called step-up controller whose design is known per se and is not of interest in detail for the invention. It may also be any other PFC circuit. Despite the PFC circuit, however, a certain amount of residual modulation remains on the intermediate circuit voltage at twice the mains frequency, that is to say normally at 100 Hz.

A so-called coupling capacitor 9, a lamp inductor 10 and the discharge lamp 1 are connected in series between the ground connection 4 and the center tap 8. The coupling capacitor 9 is used for decoupling the discharge lamp 1 from DC components; the lamp inductor 10 is used in particular to compensate for the dissipation, which in some cases is negative, of the current/voltage characteristic of the discharge lamp 1. These functions of these two circuit components are generally known and therefore do not need to be explained in any more detail here.

The same is true for a resonant capacitor 11 which is connected in parallel with the discharge lamp 1 and is likewise connected in series with the coupling capacitor 9 and the lamp inductor 10, and which is used to produce starting voltage amplitudes increased by resonance, for starting the discharge lamp 1.

To the extent that it has been described so far, the operating circuit design is completely conventional. However, the control connections of the switching transistors 6 and 7, as indicated by dashed lines in FIG. 1, are controlled by control signals from a digital control circuit 12. The digital control circuit 12 is a programmable microcontroller and uses a measurement resistor 13 to detect a signal which indicates the magnitude of the current through the lamp inductor 10.

In particular, the control circuit 12 contains a current regulation circuit, which regulates the lamp current that is tapped off via the resistor 13 at a largely constant value $I_{Lamp}$. The method of operation of the control circuit 12 is shown in more detail in FIG. 3.

The control circuit 12 can thus measure the lamp current $I_{Lamp}$ through the measurement resistor 13, and furthermore uses the operating frequency of the half-bridge oscillator together with the switching transistors 6 and 7 to regulate a constant lamp current and, finally, is able by evaluating the remaining modulation of the lamp current amplitude resulting from the modulation of the intermediate circuit voltage to identify operation that is too close to capacitive operation. As is explained with reference to FIG. 3, this is done using a threshold value for the difference, as illustrated in FIGS. 2*a* and 2*b*, between the lamp current amplitude maximum $I_{max}$ and the minimum $I_{min}$.

FIGS. 2*a* and 2*b* show schematically the qualitative form of said fluctuations for an operating state as illustrated in FIG. 2*a*, which is close to resonance but is advantageous, and for an operating state as illustrated in FIG. 2*b*, which is disadvantageous. This shows the change in the magnitude of the fluctuations of the lamp current $I_{Lamp}$ that is tapped off across the resistor 13, and the corresponding changes in the intermediate circuit voltage $U_{zw}$ that is produced between the point 5 and the ground connection 4. The lamp current is shown with its envelope, which illustrates the fluctuations in the amplitude with the intermediate circuit voltage $U_{zw}$. In fact, the lamp current $I_{Lamp}$ oscillates at the operating frequency of the half-bridge oscillator circuit, as is indicated only schematically in FIGS. 2*a* and 2*b*.

The lower area of each of the figures shows qualitative current waveforms of the half-period currents flowing through the respectively closed switching transistor 6 or 7. The limited negative deflection which can be seen initially in the left-hand current waveform in each case is typical for inductive operation and means that the current is lagging the voltage. As long as the negative peak is not too pronounced, this may be regarded as an advantageous operating state. The right-hand current waveform in FIG. 2*a* shows that the negative deflection which indicates inductive operation has virtually disappeared in the area of the small amplitudes of the lamp current, that is to say in the area of the minimum intermediate circuit voltages $U_{zw}$. The proximity to capacitive operation thus fluctuates with the intermediate circuit voltage $U_{zw}$. In a corresponding manner, the right-hand current waveform in FIG. 2*b* shows a pronounced positive peak at the start of the current waveform, which symbolizes the onset of capacitive operation. This peak leads to thermal loads and possibly to damage to the switching transistors 6 and 7, and should be avoided.

FIG. 3 uses a block diagram to show the method of operation of the operating circuit from FIG. 1. The illustrated procedure is run in the form of software that is stored in the microcontroller 12. According to the upper end of the block diagram, a measured intermediate circuit voltage (between the points 4 and 5 in FIG. 1) $U_{zw}$ is subtracted from a nominal intermediate value voltage $U_{zwnom}$. The difference is integrated by means of an integration element that is symbolized by I, is multiplied by a normalization constant that is denoted $k_3$, and is used to regulate the PFC circuit (which is not shown in FIG. 1) to a constant output voltage. For this purpose, the switching processes of the switching transistor of one switching transistor in the PFC circuit, for example a step-up controller, are clocked in an appropriate manner, that is to say, in the end, the operating frequency of the switching transistor is varied such that the output voltage and hence the intermediate circuit voltage $U_{zw}$ are as constant as possible. The PFC circuit outputs this intermediate circuit voltage via the points 4 and 5 in FIG. 1 to the half-bridge oscillator, which is formed by the switching transistors 6 and 7, and the load circuit which contains the lamp 1.

The half-bridge oscillator with the switching transistors 6 and 7 produces the lamp current $I_{Lamp}$ which flows through the lamp 1 and is measured across the measurement resistor 13 by the microcontroller 12. This is symbolized by the arrow which emerges to the right from the half-bridge oscillator in FIG. 3. The lamp current is rectified and amplified in the microcontroller by means of the elements which are denoted by the appropriate electrical engineering circuit symbols, is then filtered in a low-pass element, which is denoted by $PT_1$, in the sense of forming a mean value, and is finally converted from analog to digital form.

This is followed by a branch, which on the one hand leads to a block which is referred to as a detection circuit. This detection circuit calculates the fluctuations in the lamp current amplitude over a time period of 10 milliseconds, that is to say the difference between the maximum and the minimum of the lamp current amplitude and the envelope within said time period. If this difference is greater than a value of, for example, 50 mA, the detection circuit increases its output signal, otherwise it reduces it. The detection circuit therefore assumes that, in normal circumstances, no output signal is necessary, and its output signal is thus 0 in these normal circumstances (and cannot be reduced any further either). If the threshold value of 50 mA is exceeded, the output signal is increased by a specific fixed value and, once the 10 ms time period has elapsed, is increased by this fixed amount once again for as long as the 50 mA threshold value is exceeded.

As soon as the threshold value is no longer exceeded, the output signal is reduced in steps, with a smaller step width preferably being used than for the increase. This continues down to an output signal of 0, provided that the threshold value for the lamp current fluctuations has not been exceeded again during this period. The detection circuit thus uses the threshold value to identify excessive proximity to capacitive operation, reacts with an output signal to this detection, and slowly decreases the output signal as soon as this detection no longer occurs.

The described output signal is limited with regard to feasible measurement errors and is then subtracted from a lamp current nominal value $I_{Lamp\ Nom}$ in the subtraction element, which is symbolized by a minus sign. The actual value of the lamp current $I_{Lamp}$, averaged by the digital averaging element, is in turn subtracted from this corrected lamp current nominal value. The difference between them is integrated, and is multiplied by the normalization constant, that is symbolized by $k_1$. The integrated and normalized difference between the lamp current nominal value as corrected by the detection circuit and the lamp current actual value is then added, in the element symbolized by a circle and in accordance with the arrow annotated offset, to a value in order to adjust the operating point. This value once again represents a period duration limited with respect to feasible measurement errors, and is used for driving the switching transistors 6 and 7 in the half-bridge oscillator.

Thus, overall, it can be seen that the PFC circuit is first of all regulated at a constant intermediate circuit voltage with a nominal value $U_{zwnom}$. The intermediate circuit voltage modulation which is passed through by the PFC circuit influences the lamp current via the half-bridge oscillator, with the lamp current being regulated by a second control loop at a lamp current nominal value $I_{LampNom}$. This is done using a simple, slow I control loop, because only long-term drift effects need be taken into account. This lamp current nominal value is in turn corrected by a third control loop, in which the detection circuit is connected, such that the threshold value of 50 mA for the lamp current amplitude modulations is not exceeded all the time.

It can also be seen that, in addition to the lamp current regulation which is provided in any case, the invention has only one further slow control loop in the sense of an additional software branch, for which no further determination of measured values is necessary. In fact, the lamp current which is measured and digitized in any case is used.

If necessary, the described regulation process can be supplemented by a further regulation element in the lamp current control loop, in order to attenuate the 100 Hz modulator on the lamp current. By way of example, a PI regulator could be used instead of a simple I regulator. This changes nothing, even if relatively small lamp current modulations remain. Even if the lamp current modulations were to be smoothed out completely, they could still to this extent be used for the detection according to the invention of the proximity to capacitive operation, as the actuating signal for the lamp current control loop, representing the fluctuations in the lamp current. The fluctuations in the lamp current would then to a certain extent exist only from the control engineering point of view and would no longer actually be physically present. The invention also relates to this variant. In fact, even with perfect lamp current regulation, the current would enter the capacitive area.

Apart from this, it has already been stated that the intermediate circuit voltage $U_{zw}$ in FIG. 2 and that between the connection 5 and ground 4 in FIG. 1 could also be a deliberately modulated voltage from a DC voltage source. This would change nothing with regard to the principle of this exemplary embodiment. However, the PFC circuit would be superfluous in this case.

The invention thus allows quite precise matching of the operating circuit to continuous operation that on average is close to resonance, with little additional complexity and despite component tolerances and lamp aging processes. In contrast to the prior art, lamp operation continues when difficulties occur and changes in the current nominal value result only in a certain reduction in power. From the user's perspective, this represents a far better solution with a lamp whose brightness is decreased to a scarcely perceptible extent in comparison to a lamp which does not operate.

What is claimed is:

1. An operating circuit for a discharge lamp having an oscillator circuit for producing radio-frequency supply power for a load circuit which contains the discharge lamp from a variable supply power, and a detection circuit for identifying proximity to capacitive operation of the load circuit, characterized in that a lamp regulation circuit is provided for regulating the load circuit to a nominal regulation value, and in that the operating circuit is designed to reduce the nominal regulation value in response to the detection circuit identifying proximity to capacitive operation.

2. The operating circuit as claimed in claim 1, in which the detection circuit detects the magnitude of fluctuations, which correspond to the changes in the supply power, of the lamp current.

3. The operating circuit as claimed in claim 1, in which the detection circuit detects the magnitude of fluctuations, which correspond to the changes in the supply power, of a manipulated variable for the lamp regulation circuit.

4. The operating circuit as claimed in claim 1, in which the regulation circuit has an I regulation element.

5. The operating circuit as claimed in claim 2, in which the detection circuit carries out a comparison of the magnitude of the fluctuations with a predetermined threshold value and reduces the nominal regulation value only when the threshold value is exceeded.

6. The operating circuit as claimed in claim 1 having a PFC circuit which supplies the oscillator circuit with DC power, is connected to a rectifier and is regulated at the DC voltage.

7. The operating circuit as claimed in claim 1 having a PFC circuit which supplies the oscillator circuit with DC power, is connected to a rectifier and is regulated at the DC voltage.

8. The operating circuit as claimed in claim 7, in which a microcontroller contains a positive control circuit for the oscillator circuit and for the PFC circuit.

9. The operating circuit as claimed in claim 3, in which the detection circuit carries out a comparison of the magnitude of the fluctuations with a predetermined threshold value and reduces the nominal regulation value only when the threshold value is exceeded.

10. The operating circuit as claimed in claim 4, in which the detection circuit carries out a comparison of the magnitude of the fluctuations with a predetermined threshold value and reduces the nominal regulation value only when the threshold value is exceeded.

* * * * *